US005187931A

United States Patent [19]

Taylor

[11] Patent Number: 5,187,931

[45] Date of Patent: Feb. 23, 1993

[54] COMBUSTOR INNER PASSAGE WITH FORWARD BLEED OPENINGS

[75] Inventor: Jack R. Taylor, Cincinnati, Ohio

[73] Assignee: General Electric Company, Cincinnati, Ohio

[21] Appl. No.: 422,165

[22] Filed: Oct. 16, 1989

[51] Int. Cl.[5] ..... F02C 6/18

[52] U.S. Cl. ..... 60/39.07; 60/751

[58] Field of Search ..... 60/39.36, 751, 39.07, 60/39.02, 39.83; 415/115

[56] References Cited

U.S. PATENT DOCUMENTS

| | | | |
|---|---|---|---|
| 3,742,706 | 7/1973 | Klompas | 60/39.66 |
| 3,777,489 | 10/1973 | Johnson et al. | 60/226 |
| 3,910,035 | 10/1975 | Juhasz et al. | 60/39.23 |
| 4,098,073 | 7/1978 | Adkins et al. | 60/39.16 |
| 4,272,955 | 11/1981 | Hoffman et al. | 60/39.36 |
| 4,296,599 | 10/1981 | Adamson | 60/39.23 |
| 4,807,433 | 2/1989 | Maclin et al. | 60/39.29 |

FOREIGN PATENT DOCUMENTS

| | | |
|---|---|---|
| 1152331 | 5/1962 | United Kingdom . |
| 1217807 | 12/1970 | United Kingdom . |
| 1227052 | 3/1971 | United Kingdom . |
| 2018362 | 4/1978 | United Kingdom . |
| 2046363 | 11/1980 | United Kingdom . |
| 2103289 | 2/1983 | United Kingdom . |
| 2108202 | 5/1983 | United Kingdom . |
| 2220034 | 12/1989 | United Kingdom . |

*Primary Examiner*—Richard A. Bertsch
*Assistant Examiner*—Timothy S. Thorpe
*Attorney, Agent, or Firm*—Jerome C. Squillaro; James P. Davidson

[57] ABSTRACT

An apparatus for delivering high pressure cooling air to the turbine rotor blades of a turbo machine comprises a plurality of circumferentially spaced, forward bleed openings formed in the combustor inner casing or inner wall of the combustor inner passage of the turbo machine which are effective to reduce separation of the air flow directed through the combustor inner passage and thus reduce turbulence and pressure losses therein.

2 Claims, 2 Drawing Sheets

COMBUSTOR INNER PASSAGE WITH FORWARD BLEED OPENINGS

FIELD OF THE INVENTION

This invention relates to turbo machines, and, more particularly, to a gas turbine engine having a combustor inner passage formed with a number of circumferentially spaced, forward bleed openings which reduce pressure losses within the combustor inner passage and provide a relatively high pressure flow of cooling air to the rotor blades of the turbine of the engine.

BACKGROUND OF THE INVENTION

The air stream discharged from the high pressure stage of the compressor of a turbo machine such as a gas turbine engine is directed by a prediffuser to the combustor assembly of the engine. A portion of this high pressure air stream enters the combustor of the engine, and another portion of such stream is directed by the prediffuser into an annular combustor inner passage defined by the combustor inner casing and the inner combustor liner. That portion of the high pressure air stream which flows through the combustor inner passage is utilized to cool the combustor, to provide dilution air into the combustor downstream from the fuel injector thereof and to provide cooling air for the rotor blades of the turbine of the engine.

In many gas turbine engine designs, bleed openings are formed in the aft portion of the combustor inner passage, i.e., substantially downstream from the entrance to the combustor inner passage, and these aft bleed openings provide a path for the flow of high pressure air to the rotor blades of the turbine to cool them. It has been observed that pressure losses are created within combustor inner passages having aft bleed openings due to the formation of a substantial amount of turbulence within the combustor inner passage near its entrance or inlet. It is believed that the high pressure air stream from the compressor enters the inlet to the combustor inner passage and becomes separated into a relatively high velocity stream along the inner combustor liner which forms the outer wall of the combustor inner passage, and a rotating, turbulent air flow along the combustor inner casing which forms the inner wall of the combustor inner passage. This division or separation of the air stream, and the creation of a substantial area of turbulent flow, prevents the air stream from spanning the entire transverse dimension between the inner and outer walls of the combustor inner passage until the air stream travels relatively far downstream from the entrance to the combustor inner passage. By the time the air stream has "filled" or extended itself between the inner and outer walls of the combustor inner passage, pressure losses have been created in such high pressure stream. As a result, the diffusion air from the combustor inner passage flowing into the combustor, and the cooling air flowing out of the aft bleed openings in the combustor inner passage to the turbine rotor blades, are both at pressure levels which are less than desirable and can adversely effect the specific fuel consumption of the gas turbine engine.

SUMMARY OF THE INVENTION

It is therefore among the objectives of this invention to provide a turbo machine having a combustor inner passage in which pressure losses are substantially reduced to provide comparatively high pressure dilution air to the combustor and high pressure cooling air to the turbine rotor blades of the turbo machine.

These objectives are accomplished in a combustor inner passage defined by the combustor inner casing and inner combustor liner wherein the combustor inner casing or inner wall of the combustor inner passage is formed with a plurality of circumferentially spaced, forward bleed openings which are positioned immediately downstream from the entrance to the combustor inner passage. These forward bleed openings cause the high pressure air flow discharged from the compressor and prediffuser into the combustor inner passage to "reattach" to the inner wall of the combustor inner passage, i.e., to extend substantially across the entire transverse dimension or height of the combustor inner passage, at a forward location therealong. This substantially reduces the size of the area of turbulence or eddies within the combustor inner passage and thus pressure losses within the combustor inner passage are reduced.

In the presently preferred embodiment, an annular, aft facing step or L-shaped wall section is formed in the inner wall of the combustor inner passage which forms the forward portion of each of the circumferentially spaced, forward bleed openings. This L-shaped step is provided to help even out the flow of high pressure air in the areas of the inner wall of the combustor inner passage between adjacent bleed openings. Additionally, the vertical portion of the L-shaped step of each bleed opening reduces the height or transverse dimension of the combustor inner passage in a forward direction therefrom, i.e., that portion of the combustor inner passage upstream from the forward bleed openings is smaller in height or transverse dimension than the portion of the combustor inner passage downstream or aft from the forward bleed openings. This reduction in the height or transverse dimension of the combustor inner passage upstream from the forward bleed openings herein also tends to cause the high pressure air stream to attach or extend to the inner wall of the combustor inner passage more quickly and thus reduce turbulence and pressure losses within the combustor inner passage.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
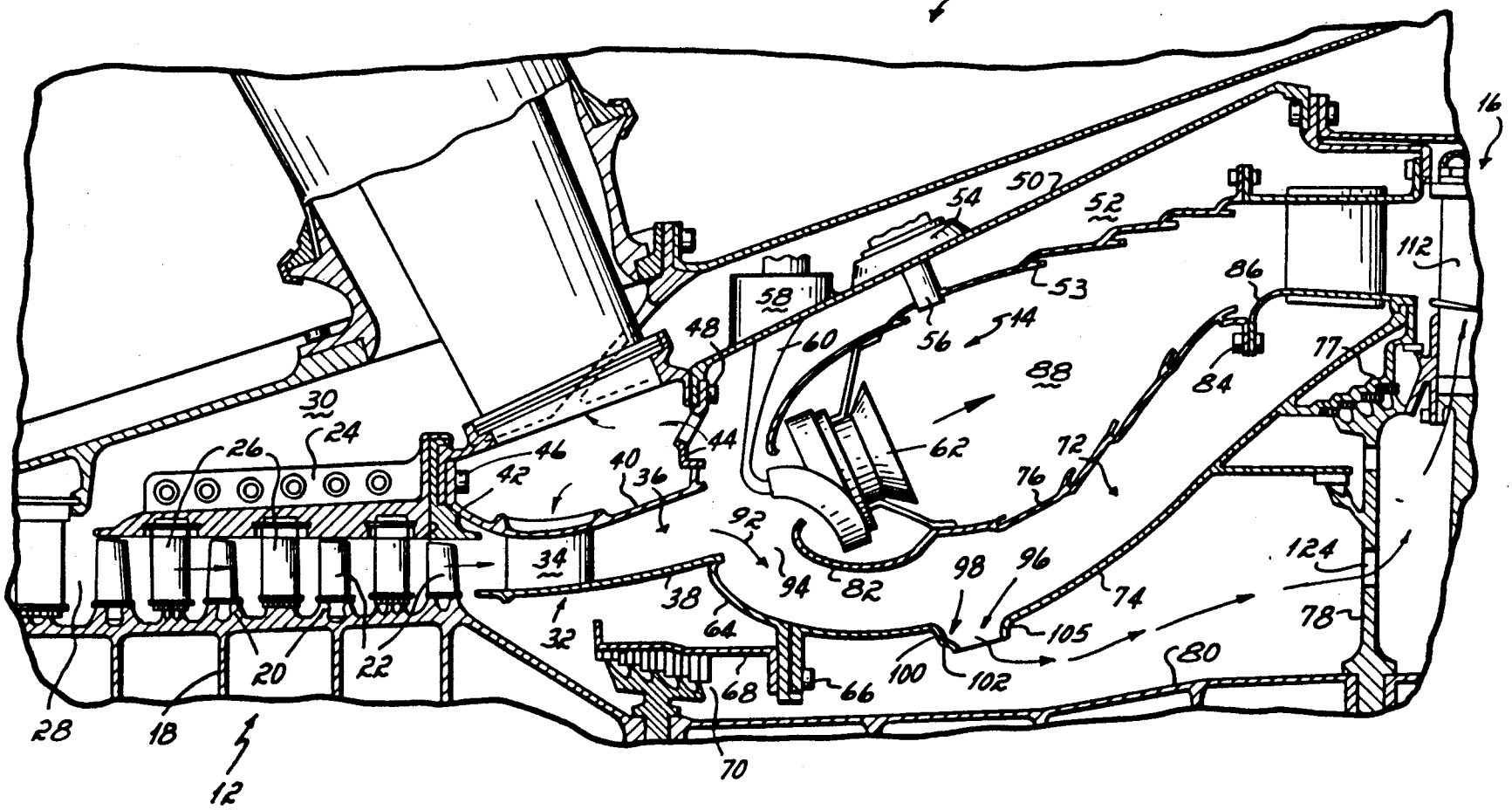
FIG. 1 is a schematic view of a turbo machine incorporating forward bleed openings in the combustor inner passage.

Referring to FIG. 1, a greatly simplified schematic view of a portion of a gas turbine engine 10 is shown for purposes of illustrating the environment within which the subject invention is utilized. The details of much of the structure of engine 10 form no part of this invention per se and are described in Johnson et al U.S. Pat. No. 3,777,489, assigned to the same assignee as this invention, the disclosure of which is incorporated by reference in its entirety herein.

For purposes of the present discussion, the gas turbine engine 10 includes a compressor 12, a combustion system 14 and a turbine 16 which drives the compressor 12. Outside air entering the engine 10 is initially compressed by the rotation of fan blades associated with a fan rotor (not shown) forming a low pressure air flow which is split into two streams including a bypass stream and a core engine stream. The core engine stream is pressurized in the compressor 12 and thereafter ignited within the combustion system 14 along with high energy fuel. This highly energized gas stream then flows through the turbine 16 to drive the compressor 12.

The compressor 12 includes a rotor 18 having a number of rotor stages 20 which carry a plurality of individual rotor blades 22. The compressor 12 has a casing structure 24 which defines the outer bounds of the compressor air flow path and includes structure to mount a plurality of stator vanes 26 aligned in individual stages between each stage of the rotor blades 22.

The compressor casing structure 24 provides an annular orifice 28 immediately upstream from one of the intermediate stages of the rotor blades 22 for bleeding interstage air from the interior of the compressor 12. This interstage bleed air is delivered to an annular plenum 30 which surrounds the compressor casing structure 24. A detailed description of the annular plenum 30 and compressor casing structure 24 is found in Anderson U.S. Pat. No. 3,597,106, which is assigned to the same assignee as the present invention.

Located immediately downstream from the last stage of the compressor rotor blades 22 is a diffuser-outlet guide vane casting 32 which includes a cascade of compressor outlet guide vanes 34 to direct the compressor discharge flow to a prediffuser 36 having inner and outer diffuser walls 38, 40, respectively. The inner and outer diffuser walls 38, 40 form the downstream flow portion of diffuser casting 32 which further includes generally conical shaped extending arms 42 and 44. The arm 42 is connected by bolts 46 to the downstream end of the compressor casing structure 24, and the arm 44 is connected by bolts 48 to the combustor outer casing 50 which is spaced from the outer combustor liner 53 to define an outer combustor passage 52. The combustor outer casing 50 supports a mounting pad 54 for an igniter 56 of the combustion system 14, and also mounts a fuel injector pad 58 connected by fuel tube 60 to the fuel injector 62 of the combustion system 14.

Referring to the lower portion of FIG. 1, the diffuser casting 32 also includes a generally conical shaped arm 64 which is secured by bolts 66 to a stationary shroud portion 68 of a seal 70. This arm 64 forms a portion of a combustor inner passage 72 which is defined by a combustor inner casing or inner wall 74, and an inner combustor liner or outer wall 76. The inner wall 74 is connected by bolts 66 at its forward end to the stationary shroud 68 and arm 64. The aft end of the inner wall 74 is carried by the stationary shroud portion 77 of a seal 78 mounted to the inner engine casing 80. The outer wall 76 of combustion inner passage 72 is connected to a combustor cowling 82 at its forward end, and is mounted by bolts 84 at its rearward end to a support arm 86 carried by the inner wall 74 of combustor inner passage 72.

A relatively high pressure stream of air is discharged from the high pressure stage of compressor 12 through the prediffuser 36 where it is split into three separate flow paths. A portion of the air stream enters the combustor 88, and the remainder of the stream is divided into two air flow streams. One air stream 92 enters the combustor inner passage 72 and the other air stream flows through the outer combustor passage 52.

Figure 2:
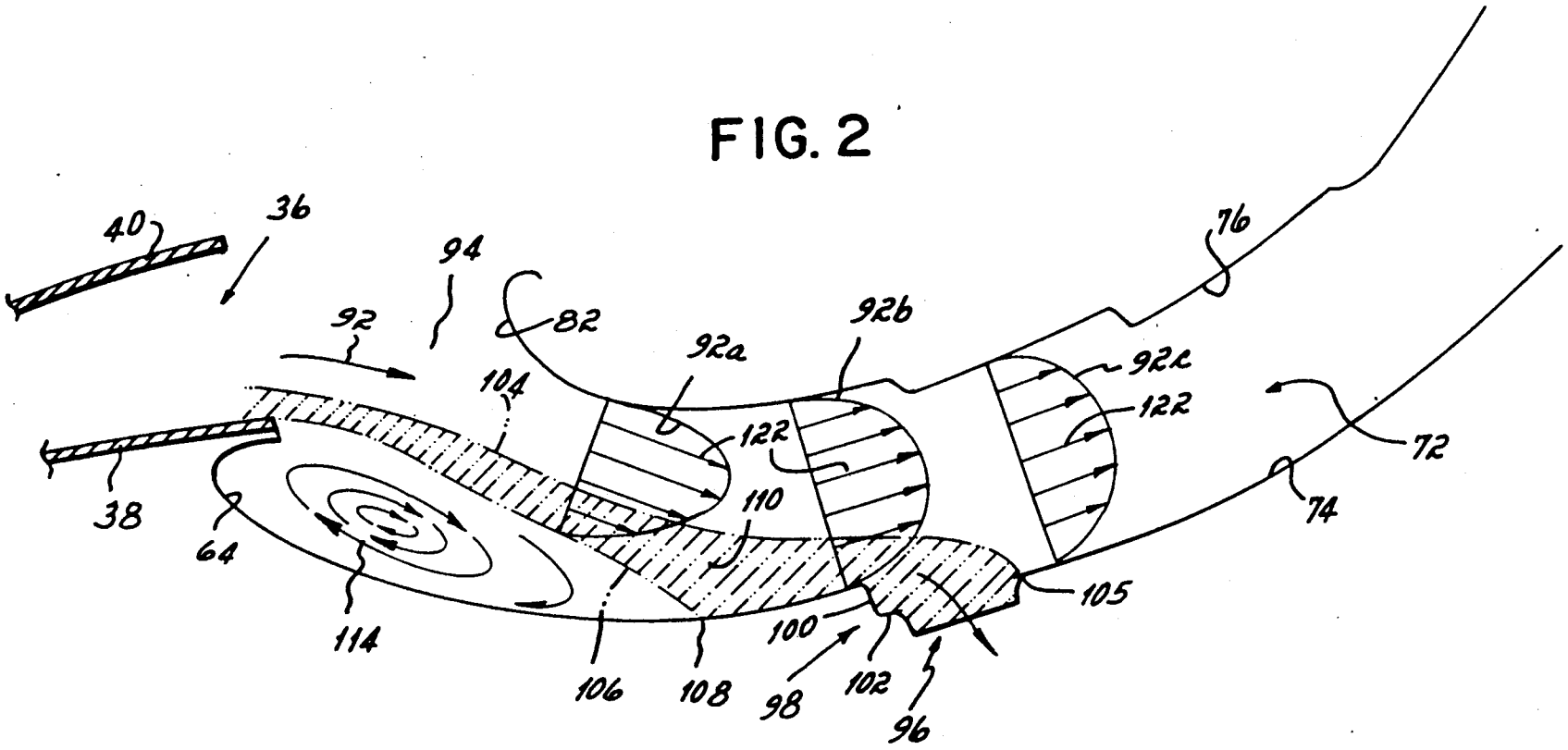
FIG. 2 is a schematic view of a portion of the combustor inner passage illustrating the effect on the air flow therethrough by the placement of the bleed openings at the forward end thereof.

As shown schematically in FIG. 2, the stream 92 of high pressure air which is directed into the combustor inner passage 72 flows through a mouth or inlet 94 defined by the combustor cowling 82 and the inner wall 38 of the prediffuser 36. The combustor inner passage 72 of this invention is particularly designed to create a smooth and relatively turbulent-free flow path for the high pressure stream 92 to reduce separation of such air stream 92 and thus minimize pressure losses within the combustor inner passage 72. This is accomplished in this invention by the provision of a plurality of circumferentially spaced, forward bleed openings 96 formed in the inner wall 74 of the combustor inner passage 72, one of which is shown in FIG. 2. An annular L-shaped step 98 is formed in the inner wall 74 of the combustor inner passage 72 having a vertically extending wall 100 and an intersecting horizontal wall 102. The L-shaped step 98 forms the forward edge of each bleed opening 96 and faces in an aft direction.

The flow of high pressure air stream 92 through the combustor inner passage 72 is schematically illustrated in FIG. 2 as a series of pressure/velocity profiles **92*a*, 92*b* and 92*c* at successive downstream positions within the combustor inner passage 72. The high pressure air flow from the compressor 12 initially enters the combustion inner passage 72 through its inlet 94 and forms an air stream 92*a* which is concentrated in an area between a dividing stream line 104 and the outer wall 76 of the combustor inner passage 72. This dividing stream line 104 extends from the inlet 94 of combustor inner passage 72 to the aft edge 105 of the forward bleed openings 96. The dividing stream line 104 is spaced from a mixing boundary line 106 which extends from the inlet 94 of combustor inner passage 72 to an attachment point 108 located on the inner wall 74 of combustor inner passage 72 between the forward bleed openings 96 and its inlet 94. The cross hatched area 110 between the dividing stream line 104 and mixing boundary line 106 represents that portion of the air stream 92 which is drawn into the bleed openings 96 and subsequently directed to the rotor blades 112 of the turbine 16 for cooling. See arrows in FIG. 1. Another portion of the air stream 92 entering the combustor inner passage 72 forms an area 114 of turbulent air flow which extends between the mixing boundary line 106 and the inner wall 74 of combustor inner passage 72** at the forward end thereof.

This invention is predicated upon the concept of placing the bleed openings 96 which supply high pressure air to the rotor blades 112 of the turbine 16 in a forward position with respect to the inlet 94 of the combustor inner passage 72. The effect of locating the bleed openings 96 in this position is to limit the size of the low pressure turbulent area 114, and thus reduce pressure losses within the combustor inner passage 72, by forcing the high pressure air stream 92 to "reattach" or engage the inner wall 74 of the combustor inner passage 72 at an attachment point 108 which is as close to the inlet 94 of the combustor inner passage 72 as possible. As shown in FIG. 2, the high pressure air stream **92*a* at a location nearest the inlet 94 to combustor inner passage 72 has a relatively high velocity, represented by the length of arrows 122, and reduced pressure due to contact with turbulent area 114. In order to reduce pressure losses, it is important for the high pressure air stream 92 to extend completely between the inner and outer walls 74, 76 of the combustor inner passage 72 in as short a distance downstream from its inlet 94** as possible.

The inner portion of the high pressure stream 92*a* is in contact with the turbulent area 114 but then reattaches to the inner wall 74 at the attachment point 108 forming a stream 92*b* with decreased velocity and increased pressure. This reattachment of the high pressure stream 92*b* occurs at attachment point 108 because of the presence of the bleed openings 96 at the forward end of the combustor inner passage 72. If the bleed openings 96 were located at the aft end of the combustor inner passage 72, as in other turbo machine designs, the attachment point 108 would be substantially downstream from the location shown in FIG. 2 creating a much larger turbulent area 114 and thus causing substantially greater pressure losses in the high pressure stream 92. The air flow continues downstream to form a stream 92*c* having higher pressure and lower velocity than streams 92*a* or *b*. As shown in FIG. 2, the velocity of the air stream decreases and the pressure increases as the air stream is forced to attach to the inner wall 74 of combustor inner passage 72 at point 108.

As illustrated in FIG. 1, the high pressure stream 92 flowing through the combustor inner passage 72 exits through the bleed openings 96 and flows through an opening 124 within the seal 78 to the rotor blades 112 of turbine 16. A portion of the stream 92 also exits the combustor inner passage 72 through dilution openings (not shown) in the outer wall 76 to supply dilution air within the combustor 88 for combination with the fuel supplied by the fuel injector 62.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An apparatus for delivering high pressure cooling air to the rotor blades of a turbine in a turbo-machine, said turbo-machine having a compressor with an aft discharge end and a combustor located between the compressor and turbine, comprising:

an annular inner wall and an annular outer wall spaced from said annular inner wall forming a combustor inner passage therebetween, said combustor inner passage having a forward end formed with an inlet communicating with the aft discharge end of the compressor for receiving a high pressure air stream therefrom, said air stream being initially in contact with said annular outer wall of said combustor inner passage but separated from said inner wall thereof immediately downstream from said inlet to said combustor inner passage;

said annular inner wall of said combustor inner passage being formed with a number of circumferentially spaced, forward bleed openings at said forward end thereof downstream from said inlet of said combustor inner passage, said annular inner wall being formed with an annular aft-facing step which forms the forward portion of each of said circumferentially spaced, forward bleed openings, the transverse dimension of said combustor inner passage being less upstream from said aft-facing step than downstream thereof, said forward bleed openings being effective to withdraw at least a portion of said air stream from said combustor inner passage and to cause said air stream to extend from said annular outer wall into contact with said annular inner wall of said combustor inner passage at an attachment point on said annular inner wall located between said forward bleed openings and said inlet of said combustor inner passage so that turbulence and pressure losses within said combustor inner passage are reduced; and means communicating with said forward bleed openings in said annular inner wall of said combustor inner passage to direct said portion of said air stream flowing therethrough to the rotor blades of the turbine for cooling.

2. The apparatus of claim 1 in which said annular aft-facing step is L-shaped including a substantially vertically extending wall and a substantially horizontally extending wall connected to said vertical wall.

* * * * *